US009234359B2

(12) United States Patent
Bourelle

(10) Patent No.: US 9,234,359 B2
(45) Date of Patent: Jan. 12, 2016

(54) TILE FLOOR ADHESIVE SPREADING AND LEVELING DEVICE

(76) Inventor: Marvon Bourelle, North Battleford (CA)

( * ) Notice: Subject to any disclaimer, the term of this patent is extended or adjusted under 35 U.S.C. 154(b) by 0 days.

(21) Appl. No.: 13/535,949

(22) Filed: Jun. 28, 2012

(65) Prior Publication Data

US 2013/0000246 A1 Jan. 3, 2013

Related U.S. Application Data

(60) Provisional application No. 61/502,636, filed on Jun. 29, 2011.

(51) Int. Cl.

| | |
|---|---|
| ***A47L 13/30*** | (2006.01) |
| ***E04F 21/16*** | (2006.01) |
| ***E04F 21/20*** | (2006.01) |

(52) U.S. Cl.

CPC ..... *E04F 21/162* (2013.01); *E04F 21/163* (2013.01); *E04F 21/20* (2013.01)

(58) Field of Classification Search

USPC ..... 401/193, 261, 263, 265, 266; 222/611.1, 611.2, 613, 617; 404/84.1, 404/84.2, 85, 86, 93, 94, 108, 110, 118, 119

See application file for complete search history.

(56) References Cited

U.S. PATENT DOCUMENTS

| | | | | | |
|---|---|---|---|---|---|
| 1,552,788 | A | * | 9/1925 | Whittaker | 401/193 |
| 2,832,273 | A | * | 4/1958 | Calabrese | 404/106 |
| 2,902,910 | A | * | 9/1959 | Malsbury et al. | 404/105 |
| 4,352,445 | A | * | 10/1982 | Cusumano et al. | 222/611.2 |
| 5,046,888 | A | | 9/1991 | King | |
| 5,387,051 | A | | 2/1995 | Valente | |
| 5,807,022 | A | | 9/1998 | McCleary | |
| 6,412,185 | B1 | | 7/2002 | Mills | |
| 6,953,298 | B2 | * | 10/2005 | Healy | 401/193 |
| 7,138,015 | B2 | | 11/2006 | Rytter | |
| 7,254,920 | B2 | | 8/2007 | Steele | |

* cited by examiner

*Primary Examiner* — David Walczak

(74) *Attorney, Agent, or Firm* — Daniel Boudwin, Esq.; Global Intellectual Property Angency, LLC

(57) ABSTRACT

A tile floor adhesive spreader device and method of spreading tile adhesive in a defined pathway comprises a rectangular frame having a first and second set of roller wheels, removable side inserts, a rear trowel blade and a defined railway for guiding the second set of wheels along a straight pathway. The frame is one comprising four side panels having width adjustment, an open interior section for retaining pouring adhesive and upstanding posts for slideably retaining the frame side inserts and allowing the inserts to slide against and follow the subfloor surface. The rear trowel blade is adjustably mounted to the rear of the frame for defining the upper surface of the adhesive aft of the frame, while the first set of wheels rolls along a surface placed over installed tile and the second set of wheels travels along an upstanding portion of an L-shaped guide rail.

12 Claims, 3 Drawing Sheets

TILE FLOOR ADHESIVE SPREADING AND LEVELING DEVICE

CROSS REFERENCE TO RELATED APPLICATION

This application claims the benefit of U.S. Provisional Application No. 61/502,636 filed on Jun. 29, 2011, entitled "Ceramic Tile Adhesive Spreader Floor Leveler." The patent application identified above is incorporated here by reference in its entirety to provide continuity of disclosure.

BACKGROUND OF THE INVENTION

1. Field of the Invention

The present invention relates to flooring adhesive and aggregate spreaders. More specifically, the present invention pertains to a rollable and guidable frame for spreading and leveling tile flooring adhesive along a subfloor surface, wherein the adhesive is contained within the frame, is evenly spread and the frame is guided along a straight pathway defined by a lateral guide rail and complimentary roller wheels secured within the guide rail.

The process of installing tile flooring involves spreading a layer of tile adhesive along a subfloor surface and distributing it evenly and along a level plane to allow the tiled placed thereon to form a level surface after completion. The adhesive is a material of viscous consistency that is spread traditionally using a handheld trowel, which is a handheld, rectangular blade having flat, notched or serrated edges. The trowel is used to spread a large amount adhesive over a given area and to level the upper surface thereof, ensuring a uniform layer having a level upper surface and a thickness absent of air pockets. The serrated or notched edges of the trowel provide a texture for the adhesive upper surface for improved engagement and adhesion to a tile placed thereonto. The process of spreading the adhesive, maintaining its level upper surface and ensuring uniform consistency is a laborious and skillful process that requires installers with specific experience to successfully complete and accomplish. Without a level and consistent layer of adhesive, the finished tile surface can be uneven and include a slope or discontinuity between tiles that is not attractive and poses a trip hazard in the finished flooring.

The significantly large area and the use of a hand trowel to spread the adhesive can create several problems for the inexperienced user, and further consume considerable amounts of time to spread correctly. As the adhesive is spread and leveled, a tile must rapidly be placed thereonto before the adhesive begins to thicken and set. Over a large area, it can be difficult to both properly spread the adhesive, place the tile and also align the tile at the same time. The prep time and skill required to spread the adhesive onto uneven subfloors is considerable, and adds to the overall job time and skill requirement of the installer. Due to the time consumed in the hand-troweling process, only a small amount of adhesive can be spread at a time before the adhesive begins to "skin" over and set; thus the tiles must be dropped into the adhesive before this process occurs. Time can very easily be lost as individuals switch between applying the adhesive to laying the flooring, and in particular those situations wherein the floor may be uneven, include low spots and for larger or more complex-geometry rooms wherein aligned installation of tile is critical for the finished floor surface design.

The present invention is submitted as an advanced means of spreading tile flooring adhesive over large swaths in a more efficient and controlled manner than traditional hand trowels and devices currently available to installers. Specifically, a spreader frame is disclosed that is adapted to be rolled along a guide rail pathway that is established adjacent to a completed row of installed tile. A flat surface is placed over the installed tile, while the guide rail is placed on the subfloor adjacent thereto and a distance therefrom defined by the width of the frame. The frame includes removable side panels to contain adhesive poured within the interior of the frame, while a trowel blade is adjustably mounted to the rear of the frame for defining the upper surface and thickness of the adhesive exiting the rear of the frame as the frame is advanced along the guide rail in a forward direction. The guide rail is a straight path that is established prior to pouring adhesive, whereafter a defined, level surface of adhesive is established for subsequent placement of tile thereonto.

2. Description of the Prior Art

Devices have been disclosed in the prior art that relate to tile adhesive and aggregate spreaders. These include devices that have been patented and published in patent application publications. These devices generally relate to improved apparatuses and tools that allow containment and spreading of material using a rollable frame or hopper. These devices, however, lack the ability to control the motion of the frame as it is advanced along the subfloor, which is a critical component and step in the present invention. The forgoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,807,022 McCleary discloses an adjustable tile floor mortar and grout spreading device, comprising a telescopically adjustable and rectangular frame, a leading and trailing edge and a pair of downwardly extending sides for containing the bonding material. A trowel blade is mounted to the trailing edge having a saw-tooth or square-tooth shape, wherein bonding material poured into the interior of the frame and onto the subfloor may be combed and leveled based on movement of the frame and the height of the rear trowel blade. The McCleary device is one that is closely related to the present invention, wherein a grout adhesive or mortar spreading frame is disclosed having a trowel blade and a moveable frame. However, the McCleary device does not disclose the use of a first and second set of wheels mounted along the lateral sides of the frame. The first set is designed to roll along a surface placed on newly laid tile, while the opposing wheels are pulley or track wheels design to travel within an upstanding rail. The rail is positioned prior to the bonding material being spread to create a straight pathway for the moveable frame after the adhesive is poured and spreading begins. The McCleary device requires the user to control the frame without using wheels, and rather drag the frame along the subfloor; thus the path of the frame is not carefully controlled.

Another such device is U.S. Pat. No. 6,412,185 to Mills, which discloses a tile laying gauge and leveling assembly, comprising a plurality of elongated side members formed of a generally L-shaped cross section and a leveling assembly having a planar central panel and extension arms for connecting to the upstanding portion of the side members. The central panel comprises a first and second edge, a first edge adapted to create a straight edge for determination of a level surface, and a second edge adapted to facilitate the spread of tile adhesive material prior to the application of the tile thereover. The side members are adjustable with respect to the floor surface to provide a level guide within which the central panel is supported, whereafter the laid tile may be checked using the straight and level edge of the central panel as it is slide along the side members. The Mills device, while providing a means to distribute a level surface of adhesive and then check the level of a tile installed thereover, does not provide a means to contain the poured adhesive bonding material. The side members are positioned along the floor and are not adapted to contain a large quantity of bonding material or prevent its outward spread. The present invention provides a frame supporting removable side members and a removable trowel for ease of cleaning, while the position of the frame is controlled using a guide rail along one side. The structure and intent of the Mills device diverges from that of the present invention.

Further, U.S. Pat. No. 7,138,015 to Rytter discloses a device for the application and spreading of adhesive material for flooring and roofing surfaces. The device comprises a frame, a plurality of wheels, an angularly extending handle and a trowel blade. The frame is designed to be pushed by a standing user, whereby the frame rolls as the trowel blade levels and spreads the adhesive material. The frame includes a pivot point for adjusting the position thereof, while the pivot points comprises two opposing side panels having a triangularly or rounded base. The device of Rytter is one that spreads large quantities of adhesive or aggregate material, and one that is less concerned with precision spreading as much as large quantity, high speed and even spreading thereof. The present invention is designed to be utilized as tile is being laid directly onto the adhesive being leveled and poured, while the pathway of adhesive is particularly controlled using a guide rail during the process.

Similar to the Rytter device is U.S. Pat. No. 5,387,051 to Valente, which discloses stand-behind frame for spreading and leveling flooring material, comprising a container for spreading material from its base surface, a sensor means for detecting irregularities in the floor surface, and control means for responding to the irregularities and moving a gate mounted on the base surface to maintain a level spread of material from the container. The device is design to receive cementitious material therein, wherein the container dispenses the material through a gate in a level manner, whereafter flooring may be placed over the spread material. No means of controlling the pathway of the container or containing the lateral spread of material is disclosed. Further, the vertical dispensing container may not be suited for more viscous adhesive, which does not readily flow through apertures as necessary for operation of the Valente base surface and control gate. The present invention provides a frame that both contains the spread of material while leveling the adhesive that is poured within the frame. The adhesive is not required to flow readily, but rather be poured into the frame and have its thickness and width controlled by a rear trough and the dimensions of the frame.

Finally, U.S. Pat. No. 5,046,888 to King describes an apparatus for finishing paving material, comprising a frame, a skid means for supporting the frame along opposing sides thereof, roller means for attaching two corners of each side to the skid means, a plate for leveling the paving material and a vibrating means for uniformly distributing the material and reducing air pockets therein. The King device is one that is particularly suited for spreading wet concrete and paving material, wherein the top surface is leveled as the frame is pulled along its skids. The structure and intent of the King device is one that diverges from the present invention, which is related to a tile floor adhesive spreader and leveler having a simple frame and removable members for containing and leveling the material therewithin.

The present invention provides a structure for the even and aligned spreading of tile flooring adhesive along a subfloor surface, wherein large areas can be quickly covered and less skill is required on the part of the installer. The frame and rear trowel blade ensures an even layer of adhesive, while the installer pours a large quantity of adhesive into the interior of the device and pulls the frame along an established guide rail pathway. It is submitted that the present invention is substantially divergent in design elements from the prior art, and consequently it is clear that there is a need in the art for an improvement to existing tile floor adhesive spreader devices. In this regard the instant invention substantially fulfills these needs.

SUMMARY OF THE INVENTION

In view of the foregoing disadvantages inherent in the known types of tile floor adhesive spreader devices now present in the prior art, the present invention provides a new spreader frame and method, wherein the same can be utilized for providing convenience for the user when spreading an even layer of tile adhesive along a defined pathway using a guided and adjustable frame.

It is therefore an object of the present invention to provide a new and improved tile floor adhesive spreader device that has all of the advantages of the prior art and none of the disadvantages.

It is another object of the present invention to provide a tile floor adhesive spreader that includes an adjustable frame width, height and rear trowel position for flexibility of use and a device that can accommodate various floor geometries.

Another object of the present invention is to provide a tile floor adhesive spreader that includes removable interior side panels that prevent adhesive from exiting the sides of the frame by sliding along the subfloor surface, while at the same time being removable for ease of cleaning between jobs.

Yet another object of the present invention is to provide a tile floor adhesive spreader two different sets of opposing wheels: a first set adapted to smoothly roll along a surface placed over installed tile, and a second set adapted to travel within a guide rail to control the direction of the frame as it advances.

A final object of the present invention is to provide a tile floor adhesive spreader that improves directional control and the consistency of the adhesive via a frame, wherein the frame moves along a defined pathway established by an upstanding bracket guide rail for increasing efficiency and facilitating tile floor installation for users of all experience level.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
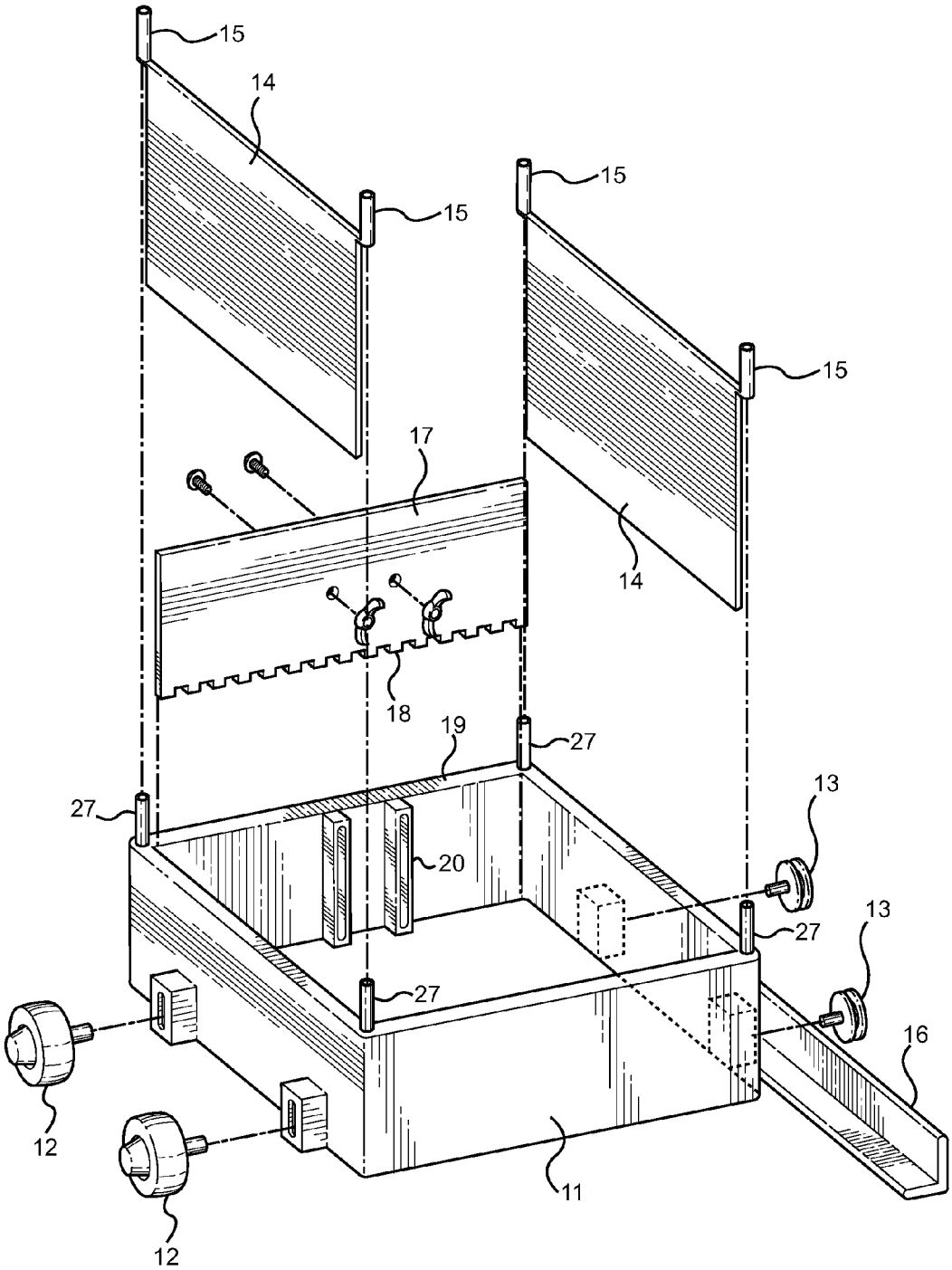
FIG. 1 shows an exploded perspective view of the present invention.

Reference is made herein to the attached drawings. Like reference numerals are used throughout the drawings to depict like or similar elements of the tile floor adhesive spreader device. For the purposes of presenting a brief and clear description of the present invention, the preferred embodiment will be discussed as used for spreading tile floor adhesive using a guided frame for even distribution along a subfloor surface. The figures are intended for representative purposes only and should not be considered to be limiting in any respect.

Referring now to FIG. 1, there is shown an exploded perspective view of the elements of the present invention that form the tile adhesive spreader and method therefor. The device comprises a rectangular frame 11 formed of a forward and rear panel and two connecting side panels. The panels are preferably slideably connected to one another, wherein the width of the overall frame 11 is adjustable to allow spreading of adhesive over a larger or smaller area. Along the corners of the frame 11 are upstanding slide posts 27 that are utilized to slideably support a pair of lateral side inserts 14. The inserts 14 slideably connect within the interior of the frame 11 along each lateral slide, wherein the bottom edge of each insert 14 is adapted to ride along the subfloor surface for the purpose of preventing adhesive from exiting the sides of the frame 11 when poured thereinto. The slideable connection is preferably a pair of complimentary post-accepting tubes 15, which slide along the upstanding posts 27 to allow deviations in the floor or low spots to be accommodated for by vertical sliding of the inserts therealong.

Along the rear of the frame is mounted a trowel blade 17, comprising a flat or serrated lower edge 18 whose height from the subfloor surface defines the height of the adhesive leaving the rear of the frame. 11. The trowel blade 17 is adjustably mounted to the rear panel of the frame, wherein its height is adjustable relative to the frame via at least one fastener-accepting vertical slot 20. Along the lateral sides of the frame 11 are a first set 12 and second set 13 of wheels, wherein the two sets perform separate functions along opposing sides of the frame. On a first side, roller wheels 12 adapted to smoothly roll along a flat surface are provided. These wheels roll along a finished tile surface or along a surface placed over the finished tile, while the second set 13 of wheels comprise slotted wheels similar in style to pulley wheels or railroad wheels. This second set 13 is adapted to ride within a guide rail 16 along the second lateral side of the frame, wherein the rail 16 provides a straight, guided pathway for which to roll the frame along.

The frame 11 itself is a device adapted to accept tile flooring adhesive or aggregate material for spreading within its interior. The upper portion of the frame 11 is open to allow ready pouring of material, while the frame 11 is then pulled along the guide rail pathway 16 such that the rear trowel blade 18 spreads the material and further defines its upper surface prior to the tiles being placed thereon. The guide rail 16 is an L-shaped member having an elongated length, an upstanding portion adapted to accept the pulley wheels 13 and a horizontal portion adapted to rest against the subfloor surface. The rail 16 is positioned along the floor to establish the desired pathway for the frame, while adhesive is poured into the frame interior, evenly spread along the rear of the frame and prevented from exiting the lateral sides of the frame via the sliding inserts. After the adhesive is spread, the inserts 14 and trowel blade are easily removably for cleaning the entire assembly. This prevents the adhesive from hardening over the components of the device, which could contaminate fresh adhesive material poured into the frame at a later date.

Figure 2:
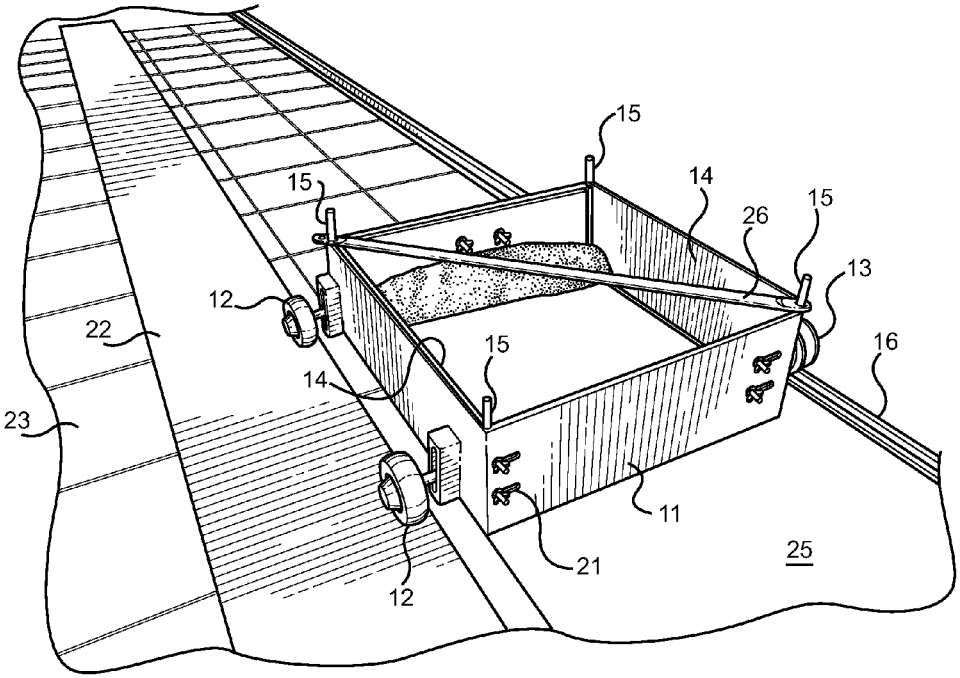
FIG. 2 shows an overhead perspective view of the present invention in a working state.
Figure 3:
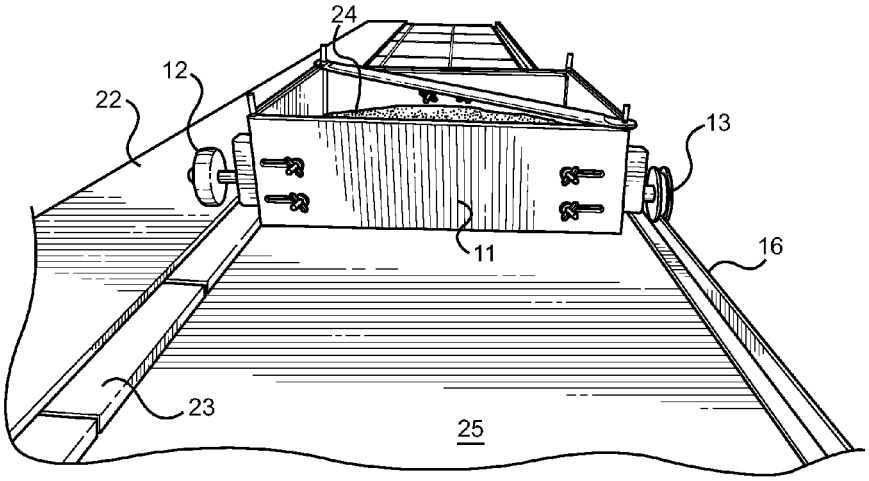
FIG. 3 shows a frontal perspective view of the present invention in a working state.
Figure 4:
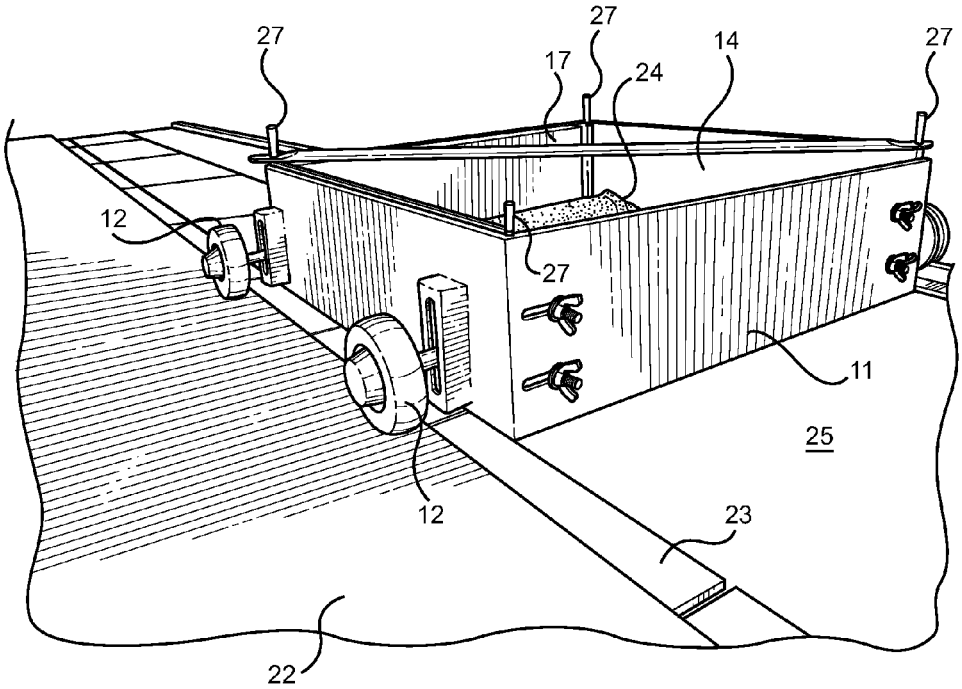
FIG. 4 shows another perspective view of the present invention in a working state.

Referring now to FIGS. 2 through 4, there are shown overhead perspective views of the present invention in a working state, spreading adhesive material 24 from the rear of the frame 11 and under the supported trowel blade 17. The frame 11 is best utilized for laying a defined pathway of fresh adhesive upon which tile flooring may be placed, wherein the spreading of the adhesive is facilitated without the use of a hand trowel. The first set of wheels 12 is adapted to run along a flat surface, either the subfloor itself or over finished tile 23, wherein a flat board or similar surface 22 is placed upon which the wheels to smoothly roll. The board 22 prevents the wheels from being stuck in the grout lines between tiles, and ensures smooth, predictable motion of these wheels. Along the opposite lateral side of the frame 11 is positioned an elongated guide rail 16, wherein corresponding rail wheels 13 are connected thereon for rolling along the channel while being prevented from deviation. The guide rail 16 establishes the forward pathway of the frame and thus the direction of fresh adhesive being laid. As the frame is advanced, tiles may be placed onto the freshly laid adhesive for establishing the new floorings. Setting the pathway of the guide rail establishes a straight length of adhesive and further aides installers when installing aligned tiles.

The frame 11 itself is preferably width adjustable 21 using slotted connections between the front/aft panels and the lateral side panels. The vertical positioning of each wheel connection, and finally the position of the trowel blade is adjustable to provide an assembly with several means of adjusting the height of the adhesive leaving the rear of the frame in operation. The floating inserts 14 travel along the subfloor and follow its contour to ensure adhesive only leaves the rear of the frame and specifically to prevent adhesive from leaking out of the sides of the frame. Along the upper portion of the frame may further be positioned a brace member 26, which diagonally connects two of the frame upstanding posts to strengthen the structure of the frame 11 and prevent warping or distortion of its rectangular cross section. Further, the rear trowel blade 17 is further mounted along a pair of vertical posts or slots, wherein bowing of the trowel blade 17 is prevented as adhesive is forced under its lower edge.

When installing ceramic tiling, a ceramic tiling adhesive must first be laid down. If the subflooring is uneven, installers spend a considerable amount of time, effort and material to prep the surface such that the tile will be installed evenly. Traditionally, this process is time consuming and extremely labor and skill intensive, wherein a hand-troweling process is required to evenly spread and prepare the adhesive along the subfloor prior to positioning the tile thereon. It is recognized that only a small amount of adhesive can be spread at a time before the adhesive begins to "skin" over and set; therefore the tiles must be dropped into the adhesive before this process occurs. Time can very easily be lost as individuals continually switch from hand-spreading and prepping the adhesive to laying the tile. The present invention provides a unique device that offers an adhesive spreading frame that is controlled using an established guide rail, which sets the forward travel of the frame and reduces installer workload with respect to frame operation and adhesive application.

The present invention further contemplates a method of spreading tile flooring adhesive using a rollable frame member adapted to accept a large quantity of adhesive and evenly spread the adhesive using a rear-mounted trowel and the forward motion of the frame. The method involves improving the means and control of spreading adhesive using a movable frame, and further for establishing a defined pathway of adhesive adjacent to freshly laid flooring. Specifically, the steps include utilizing a rectangular, adjustable frame having a rear trowel blade and two sets of lateral wheels. Using the first set of wheels to roll along a flat surface over existing flooring, and utilizing the second set of wheels to engage an elongated guide rail adjacent to the frame. The method further contemplates using the guide rail as a means to establish the pathway of the frame along a subfloor, and rolling the frame therealong to spread adhesive event from the back of the frame. Floating side inserts prevent adhesive leaking, while the removable nature of the blade and the inserts facilitate cleaning of the device between uses.

Overall, the present device and method is an improved means of spreading tile flooring adhesive in an aligned manner and uniform consistency, whereby the frame of the invention involves a leveled tracking frame and guide rail. These elements allow installers to lay the actual tile pieces directly behind the spread adhesive, as opposed to prepping a small area and placing tiles little by little. The movable frame and the ability to quickly lay uniform adhesive drastically improves individual installer's ability to both prep the subfloor and lay tile. Although ideal for anyone, this present invention can be especially useful for professional tile floor installers, as it can increase productivity and reduce the amount of time required for a given job.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flooring material spreader, comprising:

a rectangular frame having a front and rear panel connected by two lateral side panels forming a first and second side;

an elongated guide rail having an upstanding portion and a base portion adapted to rest against a ground surface;

said first lateral side panel having a pair of roller wheels rotatably connected thereto;

said second lateral side panel having a pair of rail wheels rotatably connected thereto and adapted to rollably connect to said guide rail upstanding portion;

said frame rear panel having a trowel affixed thereto, said trowel having a lower trowel edge;

a pair of floating inserts slideably connected to said frame lateral side panels and positioned within said frame interior;

said floating inserts adapted to rest against said ground surface and be slideably supported by said frame;

said floating inserts having substantially the same area as said lateral side panels.

2. The device of claim 1, wherein said slideable connection of said inserts comprises a pair of upstanding posts disposed on said frame, wherein said inserts comprise post-accepting tubes.

3. The device of claim 1, wherein said rectangular frame further comprises a diagonal brace between two frame corners to maintain said frame rectangular shape.

4. The device of claim 1, wherein said trowel blade further comprises a height adjustable connection to said frame rear panel.

5. The device of claim 4, wherein said lateral side panels are width adjustably connected to said front and rear panels.

6. The device of claim 1, wherein said roller wheels and said rail wheels rotatable connection to said lateral side panels is height adjustable.

7. The device of claim 6, wherein said lateral side panels are width adjustably connected to said front and rear panels.

8. The device of claim 1, wherein said guide rail is an L-shaped rail.

9. The device of claim 1, wherein said trowel lower edge is serrated.

10. The device of claim 1, wherein said rail wheels are slotted and adapted to accept said guide rail upstanding portion therein.

11. The device of claim 1, wherein said lateral side panels are width adjustably connected to said front and rear panels.

12. The device of claim 1, wherein said trowel blade further comprises a height adjustable connection to said frame rear panel, said roller wheels and said rail wheels rotatable connection to said lateral side panels is height adjustable, and said lateral side panels are width adjustably connected to said front and rear panels.

* * * * *